United States Patent [19]

Patel

[11] 4,313,468

[45] Feb. 2, 1982

[54] SERVO VALVE

[75] Inventor: Kishor J. Patel, Hales Corners, Wis.

[73] Assignee: Dynex/Rivett Inc., Pewaukee, Wis.

[21] Appl. No.: 119,700

[22] Filed: Feb. 8, 1980

Related U.S. Application Data

[63] Continuation of Ser. No. 44,440, Jun. 1, 1979, abandoned, which is a continuation of Ser. No. 815,467, Jul. 12, 1977, abandoned.

[51] Int. Cl.[3] ..... F15B 13/043

[52] U.S. Cl. ..... 137/625.61; 137/625.64; 137/625.69

[58] Field of Search ..... 137/625.61, 625.64

[56] References Cited

FOREIGN PATENT DOCUMENTS 2307209 11/1976 France ..... 137/625.61

*Primary Examiner*—Gerald A. Michalsky

*Attorney, Agent, or Firm*—Baker & McKenzie

[57] ABSTRACT

A servo valve having a pilot control balance network in which a variable orifice is established between the main control spool and the actuator member of a force motor wherein movement of said member causes the main spool to assume a new corresponding position that re-establishes the balance in said network.

1 Claim, 4 Drawing Figures

FIG. 1
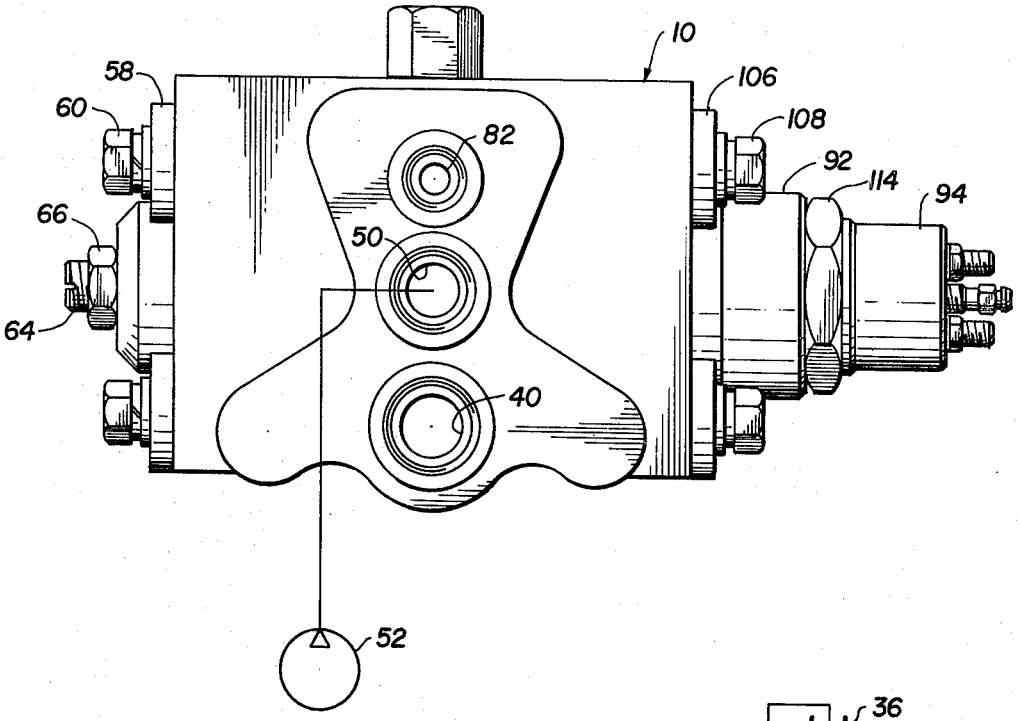
FIG. 3
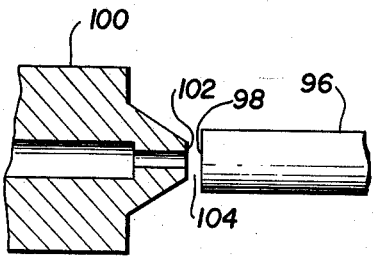
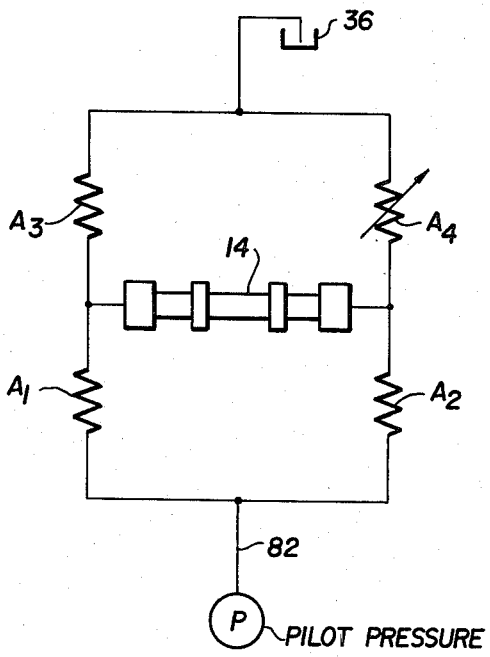
FIG. 4

SERVO VALVE

This is a continuation of application Ser. No. 44,440, filed June 1, 1979, now abandoned. That application was a continuation of application Ser. No. 815,467, filed July 12, 1977, now abandoned.

BACKGROUND OF THE INVENTION

There are many hydraulic applications in which a signal from a remote source such as an electric force motor is used to cause hydraulic response in a hydraulic control valve. Other workers in the prior art have utilized control pressure networks for establishing a movement in the main spool of the hydraulic valve in response to a movement in a remote control motor. For instance, the patent to W. C. Moog, Jr. U.S. Pat. No. 2,625,136, issued Jan. 13, 1953, discloses a pilot stage circuitry in which a half-bridge pilot circuit with a stationary nozzle is disclosed. In the Moog patent, the torque motor is a force generating device whereas in the instant invention, a displacement-type force motor is used. In Moog, the control pressure $P_c$ is fed back to the armature via a nozzle bore and reacts with the torque motor and reaction spring to achieve a constant $P_c$ regardless of the pilot pressure $P_s$ magnitude. In the instant invention, the control pressures vary with pilot supply pressure since $P_c$ is used as a feedback parameter. U.S. Pat. No. 3,410,308, issued to W. C. Moog, Jr. on Nov. 12, 1968, U.S. Pat. No. 3,430,656, issued Mar. 4, 1969 to J. W. Hawk, and U.S. Pat. No. 2,934,765, issued Apr. 26, 1960 to T. H. Carson, are also of interest.

Another patent of interest is that to E. C. Jupa, issued Mar. 7, 1961, U.S. Pat. No. 2,973,746, which shows a bridge network. In Jupa, the adjustable nozzle is stationary and not attached to the main spool as in the instant invention. Thus, Jupa does not incorporate a moving nozzle with a one-to-one position feedback. Jupa also has two variable orifices. The flapper nozzle, of course, is adjustable and his needle valve, on the end of the spool, is also adjustable.

OBJECTS OF THE INVENTION

A principal objective of this invention is to provide a servo control valve wherein an electrical signal causes a mechanical movement which varies one orifice of a bridging network, which is carried by the main hydraulic spool, which causes a movement in the spool until balance is restored and accurate and continuous feedback is present for spool positioning.

Another important objective of this invention is to provide an electro-hydraulic servo valve which is simple in its construction, rugged in its performance and accurate in its functioning.

A still further objective of this invention is to provide a pilot stage for a hydraulic control valve which comprises three fixed orifices and a single adjustable orifice, the latter of which cooperates with an electromagnetic motor displacement to establish a variable orifice area that will control main spool location.

Another important objective of this invention is to provide a force motor to proportionally vary pilot fluid pressure to thereby move a spool in proportion to the current or voltage used to adjust the space between the motor piston and a nozzle formed on the main spool.

These and other objects of the invention will become more apparent to those skilled in the art by reference to the following detailed description when viewed in light of the accompanying drawings.

BRIEF DESCRIPTION OF THE DRAWINGS

FIG. 1 is a side view of a servo valve according to this invention;

FIG. 3 is an enlarged section of the variable nozzle portion of FIG. 2; and

FIG. 4 is a schematic of the control pressure network of the apparatus of FIG. 1.

DETAILED DESCRIPTION OF THE PRESENTLY PREFERRED EMBODIMENT

Figure 2:
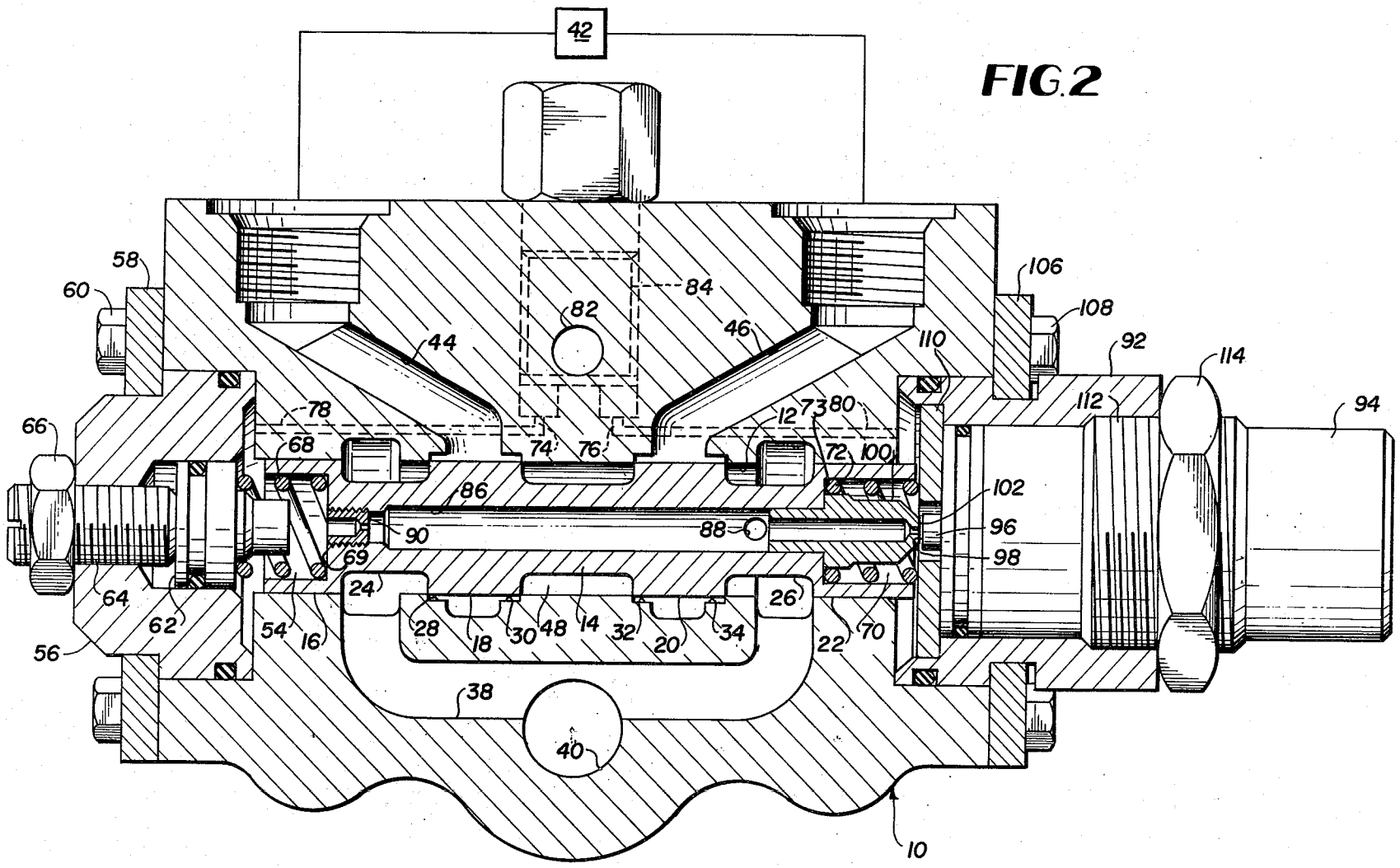
FIG. 2 is an elongated cross-sectional view, partially schematic, of the principal elements of the servo valve shown in FIG. 1.

Referring now to the drawings wherein like numerals indicate like parts, the numeral 10 indicates a valve housing having a bore 12 therethrough. Reciprocally received within the bore 12 is a spool 14 equipped with four land areas 16, 18, 20, and 22. Between land areas 16 and 18 is a groove area 24, and between land areas 20 and 22 is a groove area 26. Land areas 18 and 20 are machined with close tolerances for reasons which will become apparent hereinafter.

The valve housing 10 is machined with four internal grooves 28, 30, 32 and 34 located opposite the axial extremities of the land areas 18 and 20 when the spool 14 is in the position shown in FIG. 2. Groove areas 24 and 26 communicate with a tank 36 (shown only in FIG. 4) by way of a passageway 38 and a return port 40. Internal grooves 28 and 30 communicate with a load 42 by way of passageway 44, and internal grooves 32 and 34 communicate with the load 42 by way of a passageway 46. Passageways 44 and 46 are closed and opened by the movements of land areas 18 and 20, respectively; in the location of the spool 14 shown in FIG. 2, both passageways are closed.

In the middle of spool 14, between land areas 18 and 20, is a pressure groove 48 which communicates with a port 50 shown in FIG. 1. The port 50 is connected to the output of a pump 52, so that pressure from the pump 52 is communicated to the pressure groove 48 and can then be communicated to either passageway 44 or passageway 46, depending on the position of spool 14. Of course, in the position shown in FIG. 2, pressure from the pressure groove 48 is communicated to neither passageway. However, as the spool 14 moves to the left as viewed in FIG. 2, pressurized fluid will flow to the load 42 through internal groove 30 and passageway 44 and return to tank 36 via passageway 46 and internal groove 34. Conversely, as the spool 14 moves to the right as viewed in FIG. 2, pressurized fluid will flow to the load 42 through internal groove 32 and passageway 46 and return to tank 36 via passageway 44 and internal groove 28.

At the left end of bore 12 as viewed in FIG. 2 is a chamber 54 closed by an end gland 56 retained in position on the valve housing 10 by clips 58 and bolts 60. End gland 56 receives a piston 62, a screw 64, a jam nut 66, and a centering spring 68 located between the piston 62 and an internal ledge 69 of the chamber 54. At the right end of bore 12 is a chamber 70 which receives a second centering spring 72 located between an internal ledge 73 of the chamber 70 and apparatus described hereinafter. The piston 62, the screw 64, the jam nut 66 and the two centering springs 68 and 72 collectively serve as a mechanical "null" adjustment for the spool 14. That is, by adjusting screw 64 it is possible to initially locate land areas 18 and 20 on the spool 14 so that the internal grooves 28 and 30 align with land 18 and grooves 32 and 34 align with land 20 of spool 14.

Chambers 54 and 70 are subjected to intermediate control pressures by means of orifices 74 ($A_1$) and 76 ($A_2$), which communicate with the chambers 54 and 70 via the conduits 78 and 80, respectively. The orifices 74 and 76 are of fixed dimensions and are equal to each other. An isolated pilot port 82, which serves as a source of isolated pilot pressure, communicates with the orifices 74 and 76 via an internal filter 84 which protects those orifices from fluid contamination.

Throughout the length of spool 14 is a conduit 86. The conduit 86 communicates at its right end with the groove area 26 via a hole 88 in the spool 14 and at its left end with the chamber 54 via a third fixed orifice 90 ($A_3$) which is equal to orifice 74 ($A_1$) and 76 ($A_2$).

Attached to the right end of valve housing 10 as seen in FIG. 2 by means of a mounting cap 92 is a force motor 94 having a force motor stem 96 terminating in a planar end 98 which extends toward the right end of the spool 14. As best seen in FIG. 3, the end of the spool 14 which faces the force motor 94 carries a pressed-in nozzle 100 having a planar annular surface 102 disposed opposite and parallel to the planar end 98 of the force motor stem 96. The area between the planar end 98 of the force motor stem 96 and the planar annular surface 102 on the nozzle 100 constitutes a fourth orifice 104 ($A_4$), which, as explained hereinafter, is of variable area. As is well known in the art, the force motor 94 preferably includes a built-in bias spring to overcome any force built up on the force motor stem 96 due to the pressure at the nozzle 100 opening.

Mounting cap 92 is retained in position on the valve housing 10 by clips 106 and bolts 108. At the left end of mounting cap 92 is a flat washer 110 which abuts the centering spring 72 and which limits the travel of the spool 14 in the right-hand direction. The force motor 94 is mounted in the mounting cap 92 by threads 112 and retained for locking purposes by locking ring 114. This arrangement allows external adjustment of the force motor stem 96, which in turn permits external manual adjustment of the variable orifice 104 ($A_4$).

Initially, after the screw 64 has been adjusted to align the spool 14 in the valve housing 10 as shown in FIG. 2, the force motor 94 is adjusted so that the variable orifice 104 ($A_4$) equals the fixed orifices 74 ($A_1$), 76($A_2$), and 90 ($A_3$) in effective area. At that point, the pressures in each of the chambers 54 and 70 is exactly half the pilot supply pressure applied to pilot port 82. Since the pressures in the chambers 54 and 70 are equal to each other, the spool 14 is held stationary, which is called the "null" of the valve.

When current or voltage applied to the force motor 94 causes the force motor stem 96 to move to the left toward spool 14, orifice 104 ($A_4$) is reduced in area. As a result, the pressure in chamber 70 increases, and the spool 14 moves to the left, causing pressurized fluid to actuate the load 42 through internal groove 30 and passageway 44. Correspondingly, when current or voltage applied to the force motor 94 causes the force motor stem 96 to move to the right away from spool 14, orifice 104 ($A_4$) is increased in area. As a result, the pressure in the chamber 70 decreases, and the spool 14 moves to the right, causing pressurized fluid to actuate the load 42 through internal groove 32 and passageway 46. In each case, of course, the spool 14 will move only that amount necessary to re-establish the force balance. When the forces are again in balance, the spool 14 is held in the newly attained position. If the input to the force motor 94 is later varied, the spool 14 will quickly move to a new position re-establishing the force balance. In particular, if the input to the force motor 94 later ceases, the spool 14 will return to the "null" of the valve. Similarly, lack of controlling pressures in the chambers 54 and 70 caused, for instance, by failure of the pump 52 will cause the spool 14 to return to its "null" position.

The foregoing control pressure bridge is displayed schematically in FIG. 4. As shown therein, the subject invention provides a pilot pressure bridge arrangement in which there are four orifices, only one of which is variable. An automatic feedback is thus developed which provides accurate, continuous control.

In a general manner, while there has been disclosed an effective and efficient embodiment of the invention, it should be well understood that the invention is not limited to such an embodiment as there might be changes made in the arrangement, disposition, and form of the parts without departing from the principle of the present invention as comprehended within the scope of the accompanying claims.

I claim:

1. A fluid flow control servo valve comprising:

a valve housing having a generally cylindrical bore extending therethrough;

a supply port extending into said valve housing for receiving working fluid from an external pump;

a return port extending into said valve housing for returning working fluid from said valve housing to a tank;

an isolated pilot port extending into said valve housing and being separated from said supply port and said return port for receiving pilot pressure; a generally cylindrical valve spool dimensioned to be slidingly received within said valve housing bore, said cylindrical valve spool having an internal passageway axially extending throughout the length of said valve spool, an internally enlarged zone at one end of said valve spool forming a first chamber, and an internally enlarged zone at the other end of said valve spool forming a second chamber;

first fixed orifice means mounted within said internal passageway in said generally cylindrical valve spool generally at said one end of said valve spool and providing fluid communication between said internal passageway and said first chamber;

fixed aperture means coaxially fashioned within said internal passageway in said generally cylindrical valve spool generally at said other end of said valve spool and having internal dimensions greater than the internal dimensions of said first fixed orifice means at said one end of said valve spool and providing fluid communication between said internal passageway and said second chamber;

said valve spool being exteriorly fashioned with first and second cylindrical land areas at opposite ends of said valve spool and third and fourth cylindrical land areas axially spaced intermediate said first and second land areas, each of said cylindrical land areas being dimensioned to intimately contact said valve housing in sliding engagement within said bore of said valve housing, said cylindrical land areas forming first and second cylindrical end grooves between said first and third and fourth and second cylindrical land areas, respectively, and a third cylindrical central groove between said third and fourth cylindrical land areas;

first passage means extending through said valve housing and connecting said first and second cylindrical end grooves to said return port such that hydraulic fluid within either of said first or second cylindrical end grooves may be returned to tank;

second passage means extending through said valve housing from said supply port to said third cylindrical central groove for delivering pressurized hydraulic fluid into said cylindrical bore;

third and fourth passage means extending through said valve housing for respectively and selectively communicating said first and second cylindrical end grooves to a load and said third central groove to a load, depending on the position of said valve spool relative to said valve housing;

first and second cylindrical grooves in said valve housing radially projecting outwardly from said cylindrical bore of said valve housing and being located at the axial extremities respectively of said third cylindrical land area on said valve spool;

third and fourth cylindrical grooves in said valve housing radially projecting outwardly from said cylindrical bore of said valve housing and being located at the axial extremities respectively of said fourth cylindrical land area on said valve spool;

said third and fourth cylindrical land areas of said valve spool being axially dimensioned such that a null position may be established wherein the passage of hydraulic fluid from said third cylindrical central groove of said valve spool into said second cylindrical groove radially projecting into said valve housing and from said fourth cylindrical groove radially projecting into said valve housing into said second cylindrical end groove in said valve spool will be blocked while concomitantly the passage of hydraulic fluid from said third cylindrical central groove of said valve spool into said third cylindrical groove radially projecting into said valve housing and from said first cylindrical groove radially projecting into said valve housing into said first cylindrical end groove in said valve spool will be blocked;

aperture means generally radially projecting into said generally cylindrical valve spool for fluidically connecting said internal passageway of said valve spool with said first passage means through said valve housing such that hydraulic fluid within said internal passageway of said valve spool may be returned to tank through said return port in said valve housing;

cap means releasably mounted upon said valve housing and extending into said valve housing in a posture coaxial with respect to said generally cylindrical valve spool and adjacent to said internally enlarged zone at said other end of said valve spool forming a second chamber;

washer means mounted generally transversely across said cap means and adjacent to said second chamber;

first compression spring means mounted within said second chamber and extending coaxially within said valve spool between said washer means and an internal ledge of said second chamber, said first compression spring means being axially dimensioned to normally bias said valve spool away from a mechanical null position of said third and fourth cylindrical land areas of said valve spool with respect to said first, second, third, and fourth cylindrical grooves radially projecting into said valve housing;

end gland means releasably mounted upon said valve housing and extending into said valve housing in a posture generally coaxial with respect to said generally cylindrical valve spool and adjacent to said internally enlarged zone at said one end of said valve spool forming a first chamber;

piston means mounted for translation within said end gland means and coaxially aligned with respect to said generally cylindrical valve spool and extending adjacent to said first chamber;

second compression spring means mounted within said first chamber and extending coaxially within said one end of said valve spool between one side of said piston means and an internal ledge of said first chamber, said second compression spring means being axially dimensioned to normally bias said valve spool in a direction opposing the bias of said first compression spring means; mechanical adjustment means connected to said end gland means and abutting against the other side of said piston means for selectively translating said piston means to mechanically react said second compression spring means against said first compression spring means and mechanically bring said valve spool to a null position within said cylindrical bore of said valve housing such that hydraulic fluid is blocked from flowing from said third central groove of said valve spool to either of said second or third cylindrical grooves radially projecting outwardly from said cylindrical bore of said valve housing and from said first cylindrical groove radially projecting outwardly from said cylindrical bore into said first cylindrical end groove of said valve spool and from said fourth cylindrical groove radially projecting outwardly from said cylindrical bore into said second cylindrical end groove of said valve spool;

fifth passage means extending through said valve housing for fluidically connecting said isolated pilot port to said first chamber formed at said one end of said valve spool;

second fixed orifice means positioned within said fifth passage means and being dimensioned to be equal to said first fixed orifice means mounted within said internal passageway generally at said one end of said valve spool;

sixth passage means extending through said valve housing for fluidically connecting said isolated pilot port to said second chamber formed at said other end of said valve spool;

third fixed orifice means positioned within said sixth passage means and being dimensioned to be equal to said first and second fixed orifice means;

said first and second chambers formed at the ends of said valve spool being operable to receive intermediate control pressure from said isolated pilot port through said fifth passage means and second fixed orifice means and said sixth passage means and said third fixed orifice means, respectively;

electro-magnetic force motor means coaxially mounted within said cap means, said force motor means having a generally cylindrical force motor stem mounted for selective reciprocation within said force motor means, said force motor stem having an outer, planar end surface operably extending adjacent to but spaced from said fixed aperture means coaxially fashioned at said other end of said valve spool, said fixed aperture means comprising a nozzle pressed into said internal passageway of said generally cylindrical valve spool at said other end thereof, said nozzle having a planar annular outer surface disposed opposite to and mutually parallel with said planar end surface of said force motor stem, such that the annular zone between said planar end of said force motor stem and said planar annular surface on said fixed aperture means constitutes fourth orifice means of variable area; and means connecting said electro-magnetic force motor means to said cap means for axially adjusting said force motor means and said force motor stem such that, in an electro-magnetic null position of said force motor means, the area of said fourth orifice means may be operably set to equal the area of said first, second, and third fixed orifice means, such that said valve spool will be fluidically balanced in a null position when said force motor means is in a null position.

* * * * *